US007383593B2

(12) United States Patent
Campbell

(10) Patent No.: US 7,383,593 B2
(45) Date of Patent: Jun. 10, 2008

(54) QUIET, LOW WATER VOLUME TOILET

(75) Inventor: Charles O. Campbell, Santa Rosa, CA (US)

(73) Assignee: Wabtec Holding Corporation, Wilmerding, PA (US)

( * ) Notice: Subject to any disclaimer, the term of this patent is extended or adjusted under 35 U.S.C. 154(b) by 389 days.

(21) Appl. No.: 11/013,612

(22) Filed: Dec. 16, 2004

(65) Prior Publication Data

US 2006/0130222 A1 Jun. 22, 2006

(51) Int. Cl.
*E03D 9/10* (2006.01)

(52) U.S. Cl. ..... 4/319

(58) Field of Classification Search ..... 4/319, 4/425, 431

See application file for complete search history.

(56) References Cited

U.S. PATENT DOCUMENTS 4,550,452 A * 11/1985 Tufts ..... 4/319
4,578,831 A 4/1986 Mellinger et al.
5,502,845 A 4/1996 Hayashi et al.
5,803,114 A 9/1998 Johnson
5,918,325 A 7/1999 Arita et al.
5,983,413 A 11/1999 Hayashi et al.
6,029,287 A 2/2000 Ge et al.
6,421,843 B1 7/2002 Mellinger et al.
6,470,505 B1 10/2002 Boisvert
2002/0000005 A1 * 1/2002 Jermier ..... 4/319

* cited by examiner

*Primary Examiner*—Charles E. Phillips
(74) *Attorney, Agent, or Firm*—The Webb Law Firm

(57) ABSTRACT

A toilet assembly is provided having a bowl assembly, a fragmentation passage, a jet assembly, and a water system. The bowl assembly has a wastewater inlet and a waste water outlet. The fragmentation passage has a passage, an inlet, and an outlet. The fragmentation inlet and outlet are each in fluid communication with the passage. The passage has an upper portion, that is above a water line, and a lower portion, that is below a water line. The fragmentation inlet coupled to, and in fluid communication with, the bowl assembly waste outlet. The jet assembly has an inlet and an outlet. The jet assembly is coupled to, and in fluid communication with, the passage lower portion. The water system is coupled to and in fluid communication with the bowl assembly and the jet assembly. The water system is structured to deliver a quantity of water to the bowl assembly and the jet assembly and to remove wastewater from the fragmentation passage.

12 Claims, 3 Drawing Sheets

QUIET, LOW WATER VOLUME TOILET

BACKGROUND OF THE INVENTION

1. Field of the Invention

This present invention relates to low water volume toilets and, more specifically, to a quiet, low water volume toilet.

2. Background Information

Low water volume toilets are needed in locations that have a limited supply of water, such as on trains, aircraft, ships, and in dry climates. To reduce the volume of water required per flush, toilets have utilized complex bowl and water channel patterns as well as high pressure water. Each of these designs has their disadvantages. For example, the complex bowl shapes are difficult to create molds for and tend to be larger and/or heavier than less complex shapes. The high pressure systems create a loud noise when flushed. That is, the high pressure water is typically injected into a macerator at the base of the toilet bowl. The water jet creates a loud noise as it exits the water supply line and enters the macerator. Additionally, both designs are known to back up and flood what is typically a small rest room, e.g., the rest room on a vehicle. Further, it is desirable to have a smaller toilet that has a reduced number of connections between the toilet assembly and the facility in which it is disposed and a reduced number of parts.

There is, therefore, a need for a low volume toilet assembly that is quiet.

There is a further need for a low volume toilet assembly having a reduced number of connections between the toilet assembly and the facility in which it is disposed and a reduced number of parts There is a further need for a low volume toilet assembly that may be disposed in existing facilities.

SUMMARY OF THE INVENTION

These needs, and others, are met by the present invention which provides a low volume toilet assembly having a high pressure fragmentation passage wherein the water jet is disposed below the waterline in the fragmentation passage. By virtue of the water jet being disposed below the waterline in the fragmentation passage, the noise created by the water jet is reduced. The low volume toilet assembly further provides for a water system wherein the supply of high pressure water is controlled by a valve assembly actuated by an electronic solenoid. The valve assembly is actuated by a push button control located on the bowl assembly. This system does not require the typical plurality of parts utilized in a mechanical flush system. Additionally, the low volume toilet assembly only requires three connections; a high pressure water supply, a water outlet, and an electrical connection, in order to be coupled to a facility.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
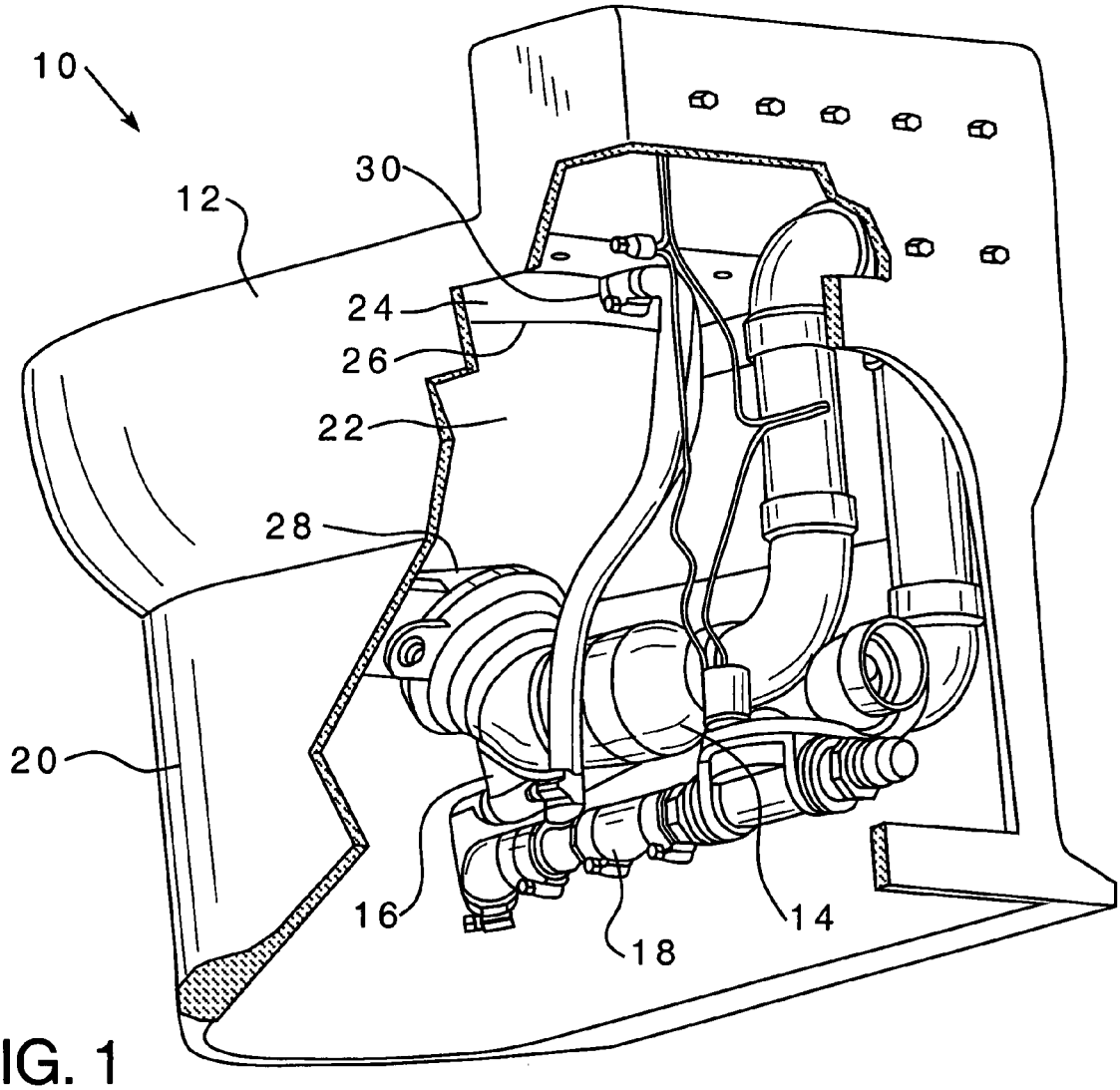
FIG. 1 is a cut away isometric view of the low volume toilet assembly.

As shown in FIG. 1, low volume toilet assembly 10 includes a bowl assembly 12, a fragmentation passage 14, a jet assembly 16, and a water system 18. The bowl assembly 12 includes a housing assembly 20, a bowl 22, and a rim 24. The housing assembly 20 is structured to enclose and support the internal components, described below. The bowl 22 is coupled to the housing assembly 20 and includes an upper edge 26 and a lower wastewater outlet 28. The rim 24 is disposed about the bowl upper edge 26. The rim 24 includes a wastewater inlet 30. The rim 24 is in fluid communication with the water inlet 30 and the bowl 22. The rim 24 is structured to distribute a flow of water about the upper edge 26 of the bowl 22 so that, as the water descends into the bowl 22, substantially all of the upper surface of the bowl 22 is washed with water. The wastewater outlet 28 is in fluid communication with the fragmentation passage 14.

Figure 2:
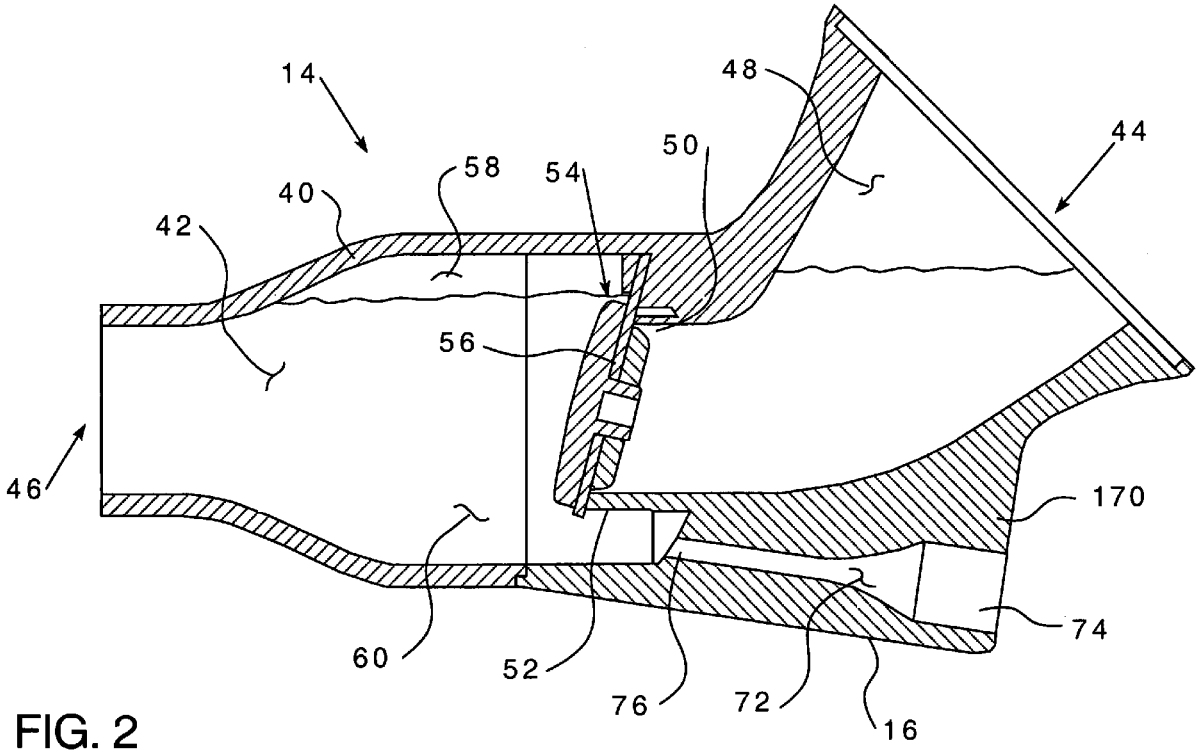
FIG. 2 is a cross-sectional view of the fragmentation passage and jet assembly.

The fragmentation passage 14, shown in FIG. 2, includes a body 40 defining a passage 42, an inlet 44, and an outlet 46. Both the fragmentation inlet 44 and fragmentation outlet 46 are in fluid communication with the passage 42. The fragmentation inlet 44 is, generally a passage 48 within the fragmentation passage body 40. The passage 48, preferably, terminates in the passage 42 with an upper edge 50 that terminates upstream of a lower edge 52. That is, the mouth of the fragmentation inlet 44 at the passage 42 is tilted with the upper edge 50 more upstream than the lower edge 52. Within the passage 42 is an anti-backup valve 54. The anti-backup valve 54 is structured to move between a first, closed position, wherein the anti-backup valve blocks the passage of fluid between the fragmentation inlet 44 and the fragmentation outlet 46, and a second, open position, wherein the anti-backup valve 54 allows fluid to pass between the fragmentation inlet 44 and the fragmentation outlet 46. The anti-backup valve 54 is a generally flat member 56 disposed at the mouth of the fragmentation inlet 44 within the passage 42. The anti-backup valve 54 is coupled to the passage upper edge 50. By virtue of the mouth of the fragmentation inlet 44 at the passage 42 being tilted, the weight of the anti-backup valve 54 will bias the lower portion of the valve member 56 against the passage lower edge 52. Thus, the anti-backup valve 54 is biased in the first, closed position. Alternatively, the anti-backup valve 54 may also have an additional biasing device, such as, but not limited to, a spring (not shown) structured to bias the anti-backup valve 54 in the first, closed position. The passage 42, as described below, is typically filled with water. As such, there is an upper portion 58 that is disposed above the waterline, and a lower portion 60 that is disposed below the waterline.

The jet assembly 16 is structured to introduce a stream of high pressure water into the passage 42 at a location below the water line and generally adjacent to the anti-backup valve 54. The jet assembly 16 includes a body 70 that defines a passage 72. The passage 72 has a first, upstream end 74 and a second, downstream end 76. The passage first upstream end 74 has a first cross-sectional area and the passage second downstream end 76 has a second cross-sectional area. The second cross-sectional area is smaller than said first cross-sectional area. Thus, the passage 72 is structured to increase the speed of a fluid flowing therethrough. As is known, a fluid moving at a high speed is at a lower pressure than a fluid moving at a lower speed. Thus, the jet assembly 16 is structured to create a low pressure zone within the passage 42 when a fluid is injected into the passage 42 through the jet assembly 16. The low pressure zone is disposed adjacent to, and downstream of, the anti-backup valve 54. The jet assembly 16 is structured to create a low pressure zone that has a sufficiently low pressure relative to the pressure upstream of the anti-backup valve 54 to overcome the bias holding the anti-backup valve 54 in the first, closed position. Additionally, as is known in the art, the configuration of the passage 72, as described above is structured to cause a stream of water flowing through the passage 72 to rotate about the longitudinal axis of said passage 72. That is, the passage 72 creates a cyclone effect in the water passing through the passage 72.

Figure 3:
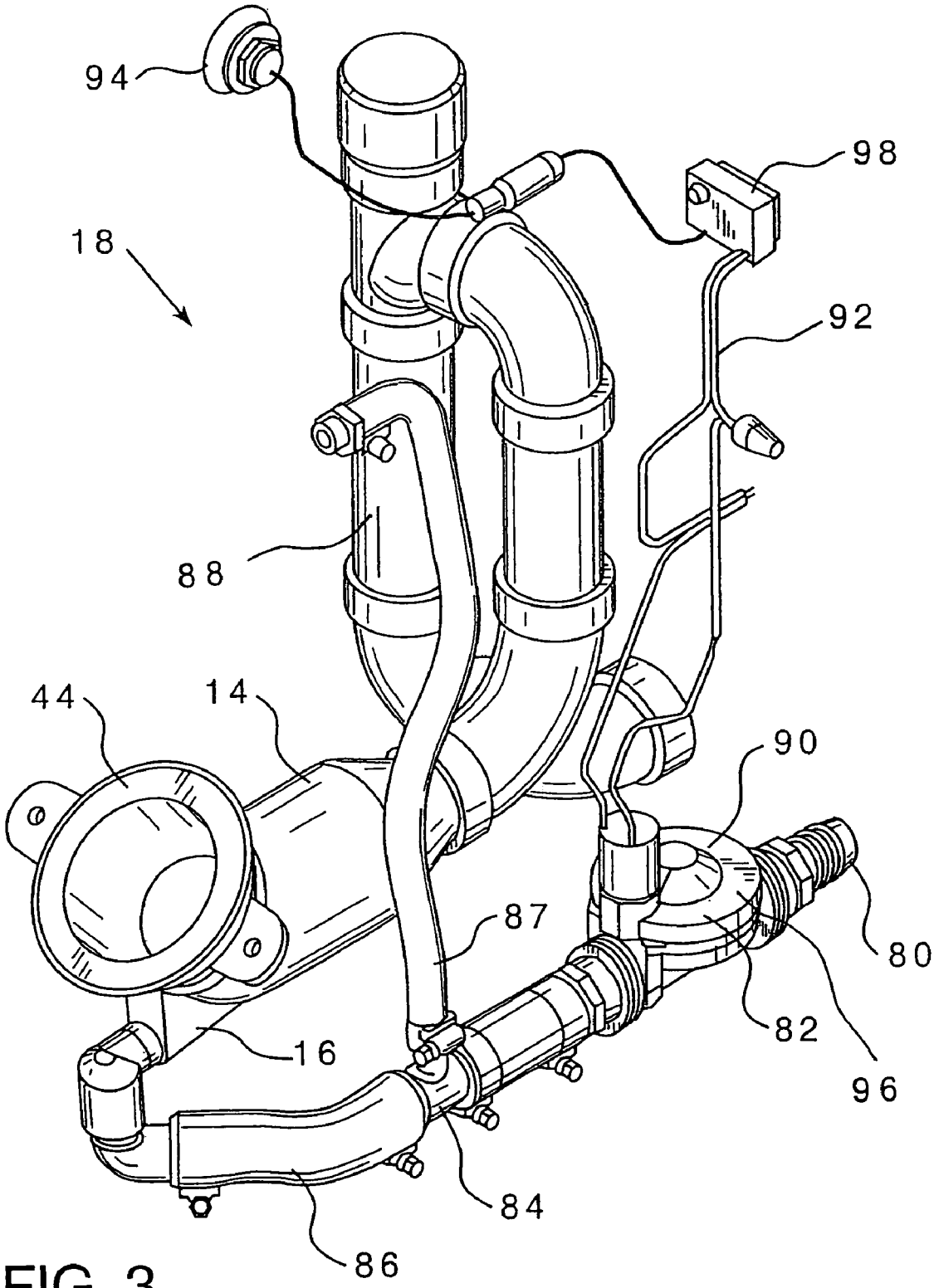
FIG. 3 is an isometric view of the interior components of the low volume toilet assembly.

The water system 18 is structured to direct water and wastewater through the toilet assembly 10. Preferably, the water system 18 is structured to use between 1 and 3 quarts per flush, and, more preferably, about 2 quarts of water per flush. As shown in FIG. 3, the water system 18 includes a high pressure water inlet 80, an inlet valve assembly 82, a water flow separator 84, a jet assembly pipe 86, a bowl pipe 87, and an outlet pipe 88. The high pressure water inlet 80 is structured to be coupled in fluid communication with a high pressure water source (not shown) and is in fluid communication with the water flow separator 84. The inlet valve assembly 82 is disposed between the high pressure water inlet 80 and the water flow separator 84. The inlet valve assembly 82 has a valve element (not shown) as is known in the art and which is structured to be moved between a first closed position, wherein water may not flow through the inlet valve assembly 82, and a second, open position, wherein water may flow through the inlet valve assembly 82. The water flow separator 84 is in fluid communication with the jet assembly pipe 86 and the bowl pipe 87. The water flow separator 84 is structured to divide the water into two streams and is, essentially, a manifold. The amount of water directed into either the jet assembly pipe 86 or the bowl pipe 87 is controlled by structures known in the art. For example, the jet assembly pipe 86 and the bowl pipe 87 may have different cross-sectional areas thereby allowing more water to flow into the pipe with the larger cross-sectional area. The jet assembly pipe 86 is in fluid communication with the jet assembly 16, and more specifically, with the jet assembly passage first upstream end 74. The bowl pipe 87 is in fluid communication with the bowl assembly 12, and, more specifically, with the rim wastewater inlet 30. The outlet pipe 88 is coupled to and in fluid communication with the fragmentation outlet 46. The outlet pipe 88 is further structured to be coupled to a wastewater system (not shown) such as, but not limited to, a sewer system or storage tank.

The inlet valve assembly 82 is preferably an electronically actuated valve. That is, the inlet valve assembly 82 includes a solenoid assembly 90, an electrical system 92 having a flush switch 94 and structured to be coupled to a source of electricity (not shown). The solenoid assembly 90 has a solenoid coupled to the valve element and is further coupled to the electrical system 92. The flush switch 94 is mounted on the bowl assembly housing assembly 20. When the flush switch 94 is actuated, electricity is supplied to the solenoid assembly 90 causing the solenoid 96, and therefore the valve element 89, to move. The electrical system 92 may also include a flush actuator timer 98 (FIG. 3) structured to control the amount of water that passes through the system during a flush cycle.

In operation, the toilet assembly 10 works as follows. As an initial condition, the inlet valve assembly 82 is in the first closed position, and the anti-backup valve 54 is in the first closed position. In this configuration, the anti-backup valve 54 substantially prevents fluid from the passage 42 from flowing upstream into the bowl 22. Additionally, the passage 42 is substantially filled with water from a prior flush. When a user actuates the flush switch 94, the inlet valve assembly 82 moves to the second, open position allowing high pressure water into the water system 18. Water is divided into two streams at the water flow separator 84; a first stream is directed into the jet assembly pipe 86 and a second stream is directed into the bowl pipe 87. The water flowing through the jet assembly pipe 86 passes through the jet assembly passage 72 wherein the speed of the water flow is increased due to the narrowing passage 72. As the water in the first stream exits the jet assembly passage second downstream end 76, the water enters the lower portion 60, that is, below the waterline. The higher speed water entering the passage 42 creates a low pressure zone adjacent to the downstream side of the anti-backup valve 54. The pressure in the low pressure zone is sufficiently low that the pressure on the upstream side of the anti-backup valve 54 overcomes the bias maintaining the anti-backup valve 54 in the first, closed position. Thus, the anti-backup valve 54 moves to the second, open position.

At substantially the same time as the anti-backup valve 54 is being moved to the second, open position, the water in the second stream enters the bowl 22. That is, water in the second stream passes through the bowl pipe 87 and through the rim wastewater inlet 30. Water in the rim 24 is distributed about the upper edge 26 of the bowl 22 and, as the water descends into the bowl 22, substantially all of the upper surface of the bowl 22 is washed with water thereby flushing the contents of the bowl 22 through the bowl outlet 28 and into the fragmentation passage 14. Wastewater from the fragmentation passage 14 exits the toilet assembly 10 via the outlet pipe 88.

When the flush cycle is complete, the inlet valve assembly 82 moves to the first, closed position preventing high pressure water from entering into the water system 18. Accordingly, flow through the water system 18 stops and the low pressure zone created by the jet assembly 16 is dissipated. With no low pressure zone in the fragmentation passage 14, the anti-backup valve 54 is again biased to the first, closed position and the anti-backup valve 54 again substantially prevents fluid from the passage 42 from flowing upstream into the bowl 22.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A toilet assembly comprising:

a bowl assembly having a wastewater inlet and a wastewater outlet;

a fragmentation passage having a passage, an inlet, and an outlet, said inlet and said outlet each in fluid communication with said passage;

said passage having an upper portion, that is above a water line, and a lower portion, that is below a water line;

said fragmentation inlet coupled to, and in fluid communication with, said bowl assembly waste outlet;

a jet assembly having a passage with an upstream end and a downstream end;

said jet assembly coupled to, and in fluid communication with, said passage lower portion; and a water system coupled to and in fluid communication with said bowl assembly and said jet assembly, said water system structured to deliver a quantity of water to said bowl assembly and said jet assembly and to remove wastewater from the fragmentation passage, wherein said fragmentation passage includes an anti-backup valve biased to the first position and disposed between said fragmentation inlet and said outlet;

wherein said anti-backup valve is structured to move between a first, closed position, wherein said anti-backup valve blocks the passage of fluid between said fragmentation inlet and said outlet, and a second, open position, wherein said anti-backup valve allows fluid to pass between said fragmentation inlet and said outlet;

wherein said jet assembly is structured to introduce a water stream into said passage at a high velocity and at a location adjacent to, and downstream of, said anti-backup valve; and wherein said jet assembly water stream creates a low-pressure zone behind said anti-backup valve, said low pressure being sufficiently strong to overcome the bias of said anti-backup valve so that said anti-backup valve moves to said second, open position.

2. The toilet assembly of claim 1, wherein said water system is structured to use between 1 and 3 quarts per flush.

3. The toilet assembly of claim 1, wherein said water system is structured to use about 2 quarts of water per flush.

4. The toilet assembly of claim 1, wherein:

said water system includes a high pressure water inlet, an inlet valve assembly, a water flow separator, a jet assembly pipe and a bowl pipe;

said high pressure water inlet structured to be coupled in fluid communication to a high pressure water source and is in fluid communication with said water flow separator;

said inlet valve assembly disposed between said high pressure water inlet and said water flow separator, having a valve element structured to be moved between a first closed position, wherein water may not flow through said valve assembly, and a second, open position, wherein water may flow through said valve assembly;

said water flow separator is in fluid communication with said jet assembly pipe said bowl pipe;

said jet assembly pipe is in fluid communication with said jet assembly; and said bowl pipe is in fluid communication with said bowl assembly.

5. The toilet assembly of claim 1, wherein said anti-backup valve is biased to the first position.

6. The toilet assembly of claim 1, wherein said jet assembly includes a passage having a first, upstream end and a second, downstream end;

said passage first upstream end having a first cross-sectional area; and said passage second downstream end having a second cross-sectional area, said second diameter being smaller than said first cross-sectional area.

7. The toilet assembly of claim 6, wherein said passage has a generally circular cross-sectional area.

8. The toilet assembly of claim 7, wherein said passage is structured to cause a stream of water flowing through said passage to rotate about the longitudinal axis of said passage.

9. The toilet assembly of claim 6, wherein:

said inlet valve assembly is actuated by a solenoid assembly;

said solenoid assembly having a solenoid coupled to said valve element and a flush switch; and said flush switch coupled to said bowl assembly.

10. The toilet assembly of claim 1, wherein:

said jet assembly includes a passage having a first, upstream end and a second, downstream end;

said passage first upstream end having a first cross-sectional area; and said passage second downstream end having a second cross-sectional area, said second cross-sectional area being smaller than said first cross-sectional area.

11. The toilet assembly of claim 1, wherein said passage has a generally circular cross-sectional area.

12. The toilet assembly of claim 1, wherein said passage is structured to cause a stream of water flowing through said passage to rotate about the longitudinal axis of said passage.

* * * * *